US005802631A

United States Patent [19]

Friedman

[11] Patent Number: 5,802,631

[45] Date of Patent: Sep. 8, 1998

[54] POOL LINER INSTALLATION METHOD AND APPARATUS

[76] Inventor: Jerome Friedman, 3 Briarwood Dr., Somerset, N.J. 08873

[21] Appl. No.: 674,094

[22] Filed: Jul. 1, 1996

[51] Int. Cl.[6] ..... E04H 4/14

[52] U.S. Cl. ..... 4/506; 52/169.7; 52/741.4

[58] Field of Search ..... 4/494, 498, 501, 4/504, 506, 507, 509; 52/169.7, 169.14, 741.4, 746.1

[56] References Cited

U.S. PATENT DOCUMENTS

| | | | |
|---|---|---|---|
| 3,184,763 | 5/1965 | Kennedy | 4/501 X |
| 3,460,705 | 8/1969 | Green | 4/506 |
| 3,815,162 | 6/1974 | Hall | 4/506 X |
| 3,889,303 | 6/1975 | Kinzel | 4/501 X |
| 4,991,294 | 2/1991 | Breiner et al. | 52/169.7 X |

*Primary Examiner*—Robert M. Fetsuga
*Attorney, Agent, or Firm*—Morton Chirnomas

[57] ABSTRACT

A method for installing a liner in a swimming pool including a wall having a liner edge retainer extending along the upper periphery. With the pool containing water, an edge of a liner is attached to the retainer at a first position on the wall and a pulling device is attached to the liner edge at a position opposite the retainer attachment. The pulling device is manipulated to drag the liner along the pool bottom and up the wall to a position opposite the first position where the edge is then attached to the retainer. A substantial portion of the pool water is scooped up in the liner and the remaining water can be pumped from between the wall and liner. The method can be used to install a second liner over an existing first liner by using different liner edge retainers. More than one embodiment of the pulling device is disclosed.

19 Claims, 5 Drawing Sheets

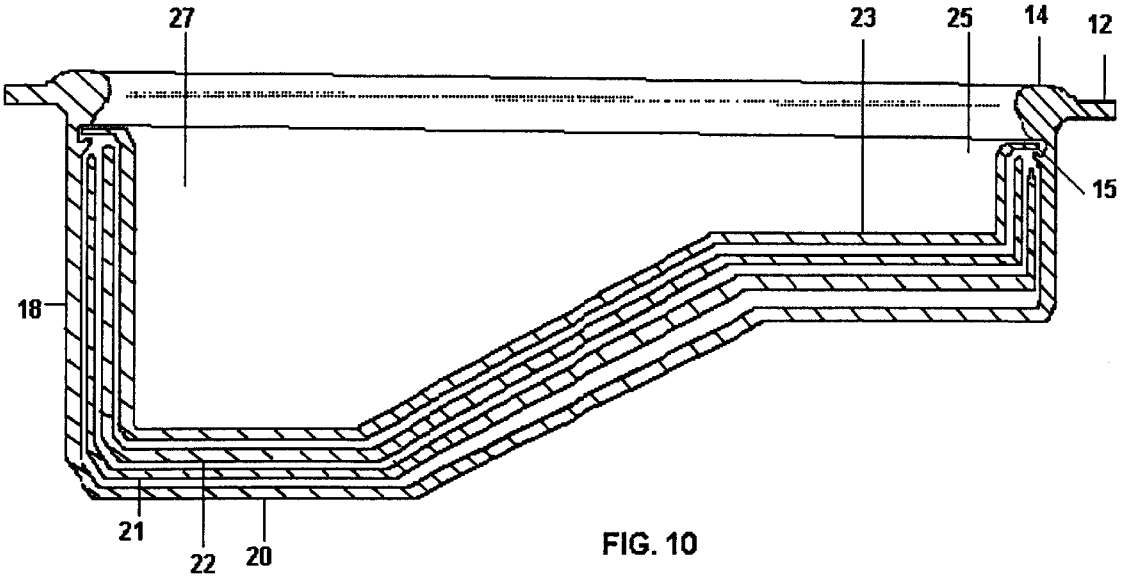
FIG. 10
FIG. 14
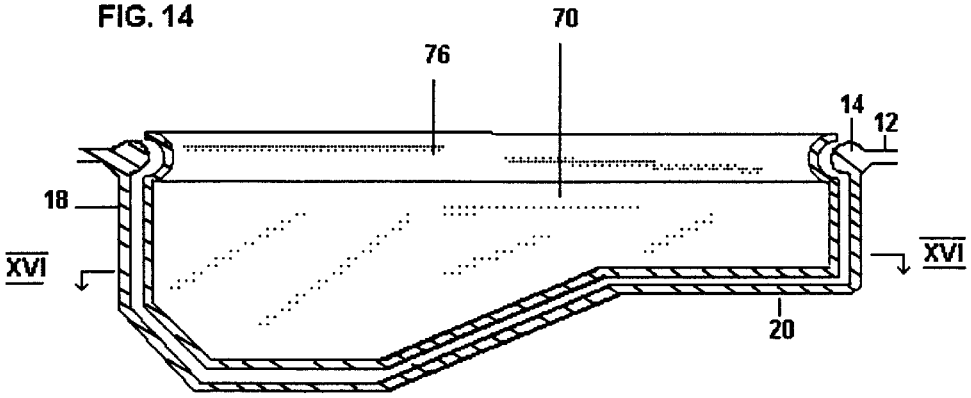
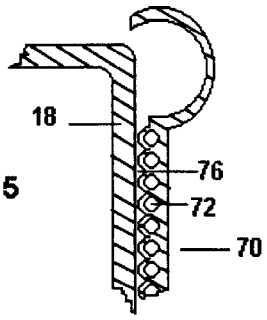
FIG. 15
FIG. 16
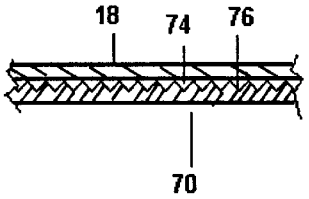

POOL LINER INSTALLATION METHOD AND APPARATUS

FIELD OF THE INVENTION

The present invention relates to a new method for the installation of a new pool liner into a swimming pool or liquid storage tank. More particularly, the present invention relates to a method for installing a liner into a swimming pool or tank which is at least partially filled with fluid. Novel apparatus have been developed for facilitating the method of the invention. Additionally, the invention relates to the relined pool or tank which is the result of the method.

BACKGROUND OF THE INVENTION

It is well known that the majority of in-ground swimming pools are of the variety known as vinyl-lined or vinyl-sided pools. These pools essentially comprise the installation of a structural shell into a hopper-shaped hole excavated in the ground. The structural shell provides the frame from which a vinyl liner, usually having a gauge thickness of from 16 mm. to about 30 mm., is suspended. The structural shell includes an upper deck or walk surrounding the hole of the pool, the rim of which is typically finished or edged with a plastic or metal coping designed to receive and retain the edges of the vinyl liner. The pool walls over which the liner hangs can be made from thin sheeting of wood, aluminum, thin steel, plastic, concrete or any other suitable material behind which is the surrounding earth. In between the vinyl liner and wall, there may optionally be a layer of polyethylene open-cell foam sheeting having a thickness of from ⅛" to about ¼" of an inch, although most original installations of in-ground vinyl-lined pools were at one time done without using foam sheeting. An average sized pool having a length and width of about 16' feet by 32' feet will use about 7 $ft^3$ of foam sheeting. The pool walls extend downward a distance of about 42 inches from the deck or walk surface before meeting the top of the floor area. The floor of the pool is a planar surface, a hopper or well, or a combination of the two features in a large pool, and usually comprises a layer such as sand, vermiculite or even concrete. These constructions rely on the pressure of the water in the pool against the walls surrounding it to maintain the walls' structural integrity as well as to maintain the original pool liner in place, in the case of a vinyl-sided pool.

The well known methods for repairing a pool that has a leak or has a liner which is leaking or worn out, is to empty the pool and effect a repair, either by locating the leak and sealing it in the case of an unlined pool, or by patching or actually replacing the entire liner in the case of a vinyl-lined swimming pool. Hereinafter, all the known methods which require emptying of the pool or tank before lining or relining shall be referred to collectively as "dry relining".

The act of emptying the contents can be wasteful and environmentally, ecologically and economically unsound, especially where chemically-treated pool water is simply sluiced into the gutter. Releasing the pool water into either the sanitary sewer system or the rainwater stormdrain system is unnecessarily taxing on natural systems and on municipal water treatment utilities.

In replacing a liner, dry relining requires removal of the old liner, together with polyethylene foam sheeting if that has been installed, further taxing already strained trash disposal resources by adding a large, heavy, non-biodegradable product to landfills. Additionally, there are risks of environmental contamination or human exposure, particularly when emptying the contents of a large fluid storage tank used for storing dangerous chemicals or petroleum products, since spills can and often do occur.

A further disadvantage to the known methods of relining is that when a pool owner knows the pool must be relined, he assumes that the water still left in the pool will be wasted and therefore he neglects to maintain the water. Failure to maintain the pool water causes it to become green with algae and become a breeding ground for mosquitoes and bacteria. Moreover, animals frequently fall into pools and drown. If the pool were being maintained, the animal would be discovered right away and removed for proper disposal. However, where a pool is being neglected while awaiting relining, a dead animal may remain rotting and decaying in the water for weeks, causing a very real health threat. This kind of neglect is less likely to occur when a pool owner knows that the pool water will be conserved in the relining process.

An additional disadvantage arises from the fact of the physical emptying itself. In many cases, leakage or degradation of a pool liner has occurred over a long period of time before the detection thereof. The leakage of chlorinated water behind the liner over a long term often causes damage by such mechanisms as rotting or corrosion to the wall behind the liner as well as to the floor below the liner. The extent of the damage and weakening of the floor and walls often cannot be determined before a pool is emptied and the liner removed. However, the known process of emptying a pool to replace a liner by using the conventional methods, may cause a weakened wall to collapse, no longer having the support of the water. Alternatively, the old liner may, with time, have become adhered to the floor and, when lifted up, pieces of the floor may be lifted up along with the liner itself, dramatically increasing the extent of the damage to the floor, with corresponding increases in cost of repairs.

A monetary and ecological disadvantage to the old method for pool liner replacement lies in the loss of anywhere from 10,000 to as much as 50,000 gallons or more of chemically-treated water, per installation, the average pool having a capacity of about 18,000 gals. to about 30,000 gals. With as many as one million liner replacements being performed each year in the U.S. alone, the impact of this loss on our water resources can easily be as great as 25 billion gallons of water wasted each year. Additionally, there is significant chemical pollution caused by the chemicals used to treat the pool water. Moreover, the chemicals must all be replaced, costing anywhere from $50.00 to easily as much as $200.00 per pool or more, depending on the time of year.

One known method of repairing or replacing a pool liner addresses the real issue of wasted water by providing a large inflatable holding tank. The tank, which is placed adjacent to the pool, is then filled with water pumped from the pool into the tank. Then, in accordance with all other known methods, the old liner and foam sheeting are removed from the emptied pool and disposed of, repairs are made to the floor and walls as necessary and the pool is then refilled with the water from the tank, by means of a pump. Other than water conservation, this method does not address the disadvantages of the known methods mentioned hereinabove.

Though environmentally sound, this method does not address the structural problems created by emptying a pool having questionable structural integrity. Additionally, the holding bag method is just as time consuming as the other known methods. A typical liner replacement job comprises emptying a 20,000 gallon or so pool . . . removal and disposal of the old liner and foam sheeting . . . as well as removal of any stairs, light fixtures, skimmer plates, drain plates and other items which may be incorporated into the structure of the pool . . . making repairs to the floor and walls as needed . . . installing the new liner . . . replacing all fixtures, stairs, plates, etc . . . refilling the pool . . . and adjusting the new liner at various times during the water replacement to remove wrinkles.

The known processes recounted hereinabove usually take at least eight hours, and often take from 2–4 days, depending on the household water pressure. It usually requires the workmen to return to the site at least two and very often three times. The installer must return when the shallow end of the pool has 1–2 feet of water in it to make last adjustments and attempt to remove any wrinkles in the liner as well as to check the large vacuum which must be operate during the entire refilling process to keep the new liner sucked back into position. A lot of events can occur during the long refilling process which can cause further delays in completing the relining. As an example, if heavy rains fall during the time that the pool is refilling, the groundwater build-up behind the walls and under the pool floor could cause the liner to be floated away from the structural shell, the floor of the pool could heave, the walls of the pool could collapse or worse. All of these occurrences would require a complete re-emptying of the pool for repairs to be made and the refilling process must begin again.

In a market which is ever increasingly crowded and highly competitive, time and efficiency are often the only factors separating profit from loss. The main factors in determining the length of time which a pool liner replacement job will take are the size of the pool, the extent of the damage to the pool's structural shell, the weather and the time it takes to refill the pool from a garden hose, since the job cannot be completed until the pool has been refilled allowing final adjustments to the liner.

As discussed above, the simple act of removing 20,000 or more gallons of water, then refilling that water from a household tap can easily consume two to four days, during which time, the installer must return to the site to make adjustments to the new liner so that it settles in place smoothly, without extensive wrinkling. The floor of a pool can be damaged by the process of removing the old liner, even where it wasn't already weakened by leakage. If the weather has been intermittently, but frequently inclement, most installers would want to wait a period of time, perhaps days, to allow groundwater to recede, thereby reducing the risk of a cave in of the pools walls or having the floor of the pool heave up from ground water pressure. Wherever a pool is located in a geographic region having a high water table, it is necessary to set up a dry well or install well points for draining away water from the ground immediately below and around the pool before beginning a liner replacement using the known methods.

An additional disadvantage to dry relining arises from the fact that most liners are manufactured slightly smaller than the pool for which they are intended. A liner may be as a whole foot shorter or shallower than the pool into which it will be installed. The liner manufacturers purposely do this so that there is less of a chance that the liner installer will have trouble with wrinkles in the liner. The liner manufacturers and installers are relying on the heat of the sun, high velocity vacuum pumps and the weight of the water to stretch the liner into place in the wall corners and floor corners of the pool. The problem which is created by this reliance on stretching is that, due to the dry contact surface between the liner and the surface underneath it, the liner does not necessarily settle into or get sucked into the corners by the vacuum and then stretch a little. The dry surface contact inhibits sliding of the liner on the undersurface, causing greater localized stretching. Most of the localized stretching occurs in either the floor and wall corners or at the top edge of the liner adjacent to or just below the liner bead. Any stretching of the liner necessarily causes thinning of the liner and it is widely known that the areas of a liner which exhibit the highest occurrence of failure due to pinholes, abrasion, tears and the like are just those areas which experience localized stretching in the installation process.

It was mentioned hereinabove that some pool liners have been installed with a polyethylene foam sheet between the pool wall and the liner. However, that is the exception, not the rule, when speaking of original installations. The foam sheeting, as much as 7 $ft^3$ worth, is primarily used for re-lining a pool. The pool wall under the original liner often has abrasive, corroded areas which cause unsightly bumps in a new liner and could cause premature failure of the new liner if the polyethylene foam sheet were not first installed. However, reliance on the foam sheet has undesirable side effects. One of these consequences is that the production of the foam sheeting is accomplished by processes which are harmful to the environment, most notably, by using CFC's and other compounds known to damage the Earth's ozone layer. A second of these consequences is that a dry relining will usually remove existing foam sheeting and replace it with new foam sheeting. This causes a trash problem which is not insignificant.

Because the successful pool liner repair business will be that which can do the least expensive, highest quality liner replacement in the least amount of time, controlling the above-identified factors can result in extraordinary cost benefits, resulting in lower costs to the consumer and greater earnings to the pool contractor.

Another aspect of pool maintenance relates to the process of chemically bleaching or otherwise washing the walls and floor of a pool. Over time, the walls and floors of pools can be become severely stained by the processes of algal and fungal growth. The known methods for resurfacing or bleaching a badly discolored pool require emptying all the water from the pool and either applying bleaching agents such as muriatic acid, repainting, sandblasting or other similar techniques, depending on whether the pool is concrete or vinyl-lined. The muriatic acid is co corrosive and so much heavier than air that large fans must be employed to blow the vapors away from the work area and into the atmosphere to avoid injury to the personnel. As mentioned with respect to vinyl-liner replacement, one of the most important factors in the expense of performing this kind of pool maintenance is that of time . . . the time to drain the pool (usually several hours) . . . the time to treat the wall surface (many hours, even a day or two) . . . the time to refill the pool (at least one day) . . . and the time to come back after the pool is refilled to check the liner and ascertain satisfactory status of the service.

Another drawback to the dry relining method for replacing a pool liner is the potential hazards to installers. There are the dangers inherent in working on slippery, sloped surfaces. Slipping and falling, with subsequent injury resulting, are common occurrences in the liner installation population. Another hazard is that of electrocution. Dry reliners usually use pumps to pump the pools dry before beginning their installation. Additionally, vacuums are used to draw newly installed liners into place up against the walls until the pool has been substantially refilled. The use of these and other electrical devices by installers are responsible for several deaths by electrocution each year.

SUMMARY AND OBJECTS OF THE INVENTION

It is therefore one object of the present invention to provide a method for relining a vinyl-sided pool without removing the water therefrom as a pre-condition.

It is a further object of the present invention to provide a method for relining a vinyl-sided pool without risking the collapse of the side walls of the pool being repaired due to draining the pool.

It is yet a further object of the present invention to provide a method for lining a swimming pool without risking lifting up or cracking and heaving of the pool floor from hydrostatic pressure.

It is still a further object of the present invention to provide a method for relining a vinyl-sided pool which conserves water and pool chemicals.

It is yet a further object of the present invention to provide a method for relining a vinyl-sided pool which is at least twice as fast as conventional methods.

It is yet another object of the present invention to provide a method for relining a vinyl-sided pool which does not generate any significant amount of solid waste products.

It is still a further object of the present invention to provide a method for relining a vinyl-sided pool which reduces demand for materials made by ecologically unsound processes.

It is still another object of the present invention to provide apparatus for relining a vinyl-sided pool using the method of the invention.

Yet another object of the present invention is to provide a liner having a longer life span by eliminating abrasion between the new liner and deposits on the substructure walls and floor.

Yet a further object of the present invention is to provide extra resistance against subsequent liner failure due to small tears or holes by providing adhesion between the old liner and the new liner.

Still a further object of the present invention is to provide an installation where any stretching and thinning of the new liner is uniformly spread out over the entire liner and not localized in the corner regions and liner bead regions.

Yet a further object of the present invention is to provide a method for installing a pool or tank liner which reduces risk of injury to installers due to slipping and electrocution.

Still another object of the present invention is to provide a method for resurfacing the wall and floor surfaces of vinyl-lined and concrete swimming pools without necessitating the emptying and subsequent refilling of the pool.

Yet another object of the present invention is to provide a method for resurfacing the wall and floor surfaces of vinyl-lined and concrete swimming pools which limits environmental and worker exposure to the bleaching chemicals and fumes.

Still another object of the present invention is to provide a method for resurfacing the wall and floor surfaces of vinyl-lined and concrete swimming pools which permits a high percentage of recovery of the chemicals used for the resurfacing treatment.

These advantages and others not specifically enumerated are accomplished by the method and apparatus of the present invention. The method is described as being particularly well-suited for relining an in-ground swimming pool. Most in-ground swimming pools include a deck, either of concrete, brick or wood. The deck is often edged by a coping, the deck and coping surrounding a hopper or well defined by at least one continuous wall often having a rectangular or oval shape and floor of varying depth. In vinyl-lined pools, the hopper is lined by a semiflexible liner, having a thickness gauge of 16 mm. to about 30 mm., and usually made from polyvinyl chloride (PVC). The liner has a shape substantially conforming to the shape of the hopper. In vinyl-lined pools, a liner is attached to the coping by a bead formed along a top edge of the liner, the bead being inserted into a groove provided in the coping. The liner is substantially filled with pool water.

Above-ground pools, which are often surrounded by a wood or aluminum deck, have walls which are substantially above the ground surface and supported by an external frame. These often have a rim cap about four to six inches in width which sits on top of the upper edge of the pool wall. A liner is attached usually by one of two methods: [1] by draping the top of the liner over the edge of the wall and then placing the rim cap over and down onto the wall edge and liner; or [2] by providing a rim cap having a groove similar to that of in-ground pool coping, and, using a liner with an edge bead, inserting the edge bead into the groove of the rim cap.

The method of the invention substantially comprises the general steps of:

[a] preparing the pool to receive a new liner;

[b] attaching weighted pulling means for safely pulling the new liner along the bottom of the pool to the second end of the pool and up the wall opposite the first end without damaging or unduly stretching the new liner;

[c] pulling the new liner along the bottom of the pool from one end of the pool to the opposite end of the pool and up the wall opposite the first end;

[d] removing the weighted pulling means from the new liner and attaching the edge of the new liner to the coping all around the pool by inserting the bead into the available groove;

[e] pumping water from between the new and old liners into the new liner; and

[f] reinstalling hardware, steps, skimmer plates, drain plates and the like.

The method of removing stains from the floor and wall of a concrete pool without necessitating removal and subsequent replacement of the water includes the steps of:

[a] Selecting a material having an uneven surface and from which a liner or similar sheet-like structure can be made. The material must able to withstand exposure to the corrosive chemicals or cleaning solvents used for bleaching or cleaning away algal and fungal staining from pools. By an uneven surface, it is meant that a surface interrupted by ridging, serration, bubbles and the like, for example the bubble-wrap style material used to make swimming pool solar blankets;

[b] making a sheet or liner from the material which is sized and shaped to cover at least the entire surface area of the pool's walls and floor;

[c] attaching a weighted pulling means for safely pulling the liner or similar sheet-like structure along the bottom of the pool without damaging or unduly stretching the sheet;

[d] pulling the sheet along the bottom of the pool from a first end of the pool to the second end of the pool and up the wall opposite the first end;

[e] removing the weighted pulling means from the sheet or liner;

[f] pumping water from between the sheet or liner and the pool's wall and floor;

[g] injecting cleaning solution between the sheet or liner and the pool wall and floor;

[h] adjusting the sheet once or twice to ensure uniform stain removal; and

[i] removing the cleaning fluid and removing the sheet from between the pool water and the pool wall and floor.

BRIEF DESCRIPTION OF THE DRAWINGS

For a more complete understanding of the present invention, reference may be had to the following detailed description of exemplary embodiments taken in conjunction with the accompanying figures of the drawings, in which:

FIG. 10 is a cross-sectional view of an exemplary embodiment of a vinyl-lined in-ground pool which has been relined in accordance with one exemplary embodiment of the present invention;

FIG. 14 is a cross sectional view of a pool having therein a liner adapted for use in chemically resurfacing and removing stains from a pool wall and floor;

FIG. 15 is a cross-sectional view, in detail, of a portion of liner adapted for chemically resurfacing and removing stains from a pool wall and floor; and FIG. 16 is a cross-section in detail, of a top plan view of a portion of another exemplary embodiment of a liner adapted for chemically resurfacing and removing stains from a pool wall and floor.

DETAILED DESCRIPTION OF THE EXEMPLARY EMBODIMENTS

Figure 1:
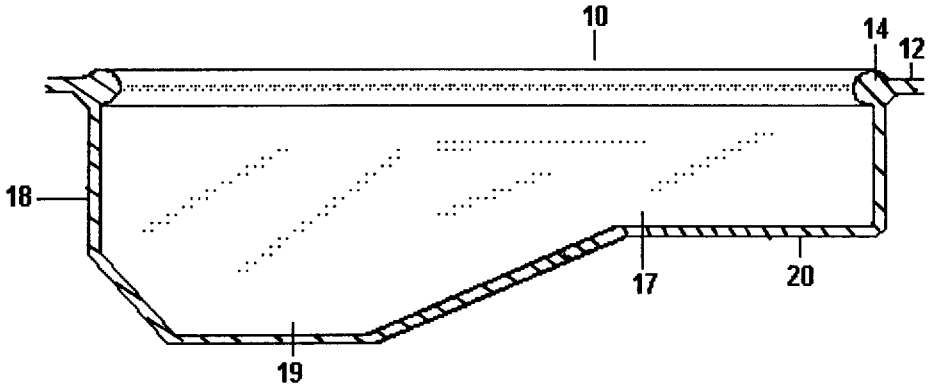
FIG. 1 is a cross-section of an elevational view of a typical construction of an in-ground unlined swimming pool.

The detailed description which follows will discuss exemplary embodiments of the invention practiced in slightly varying environments. For ease of discussion and understanding, similar components have been assigned similar reference numerals increased by 100, 200, 300, etc..

Figure 2:
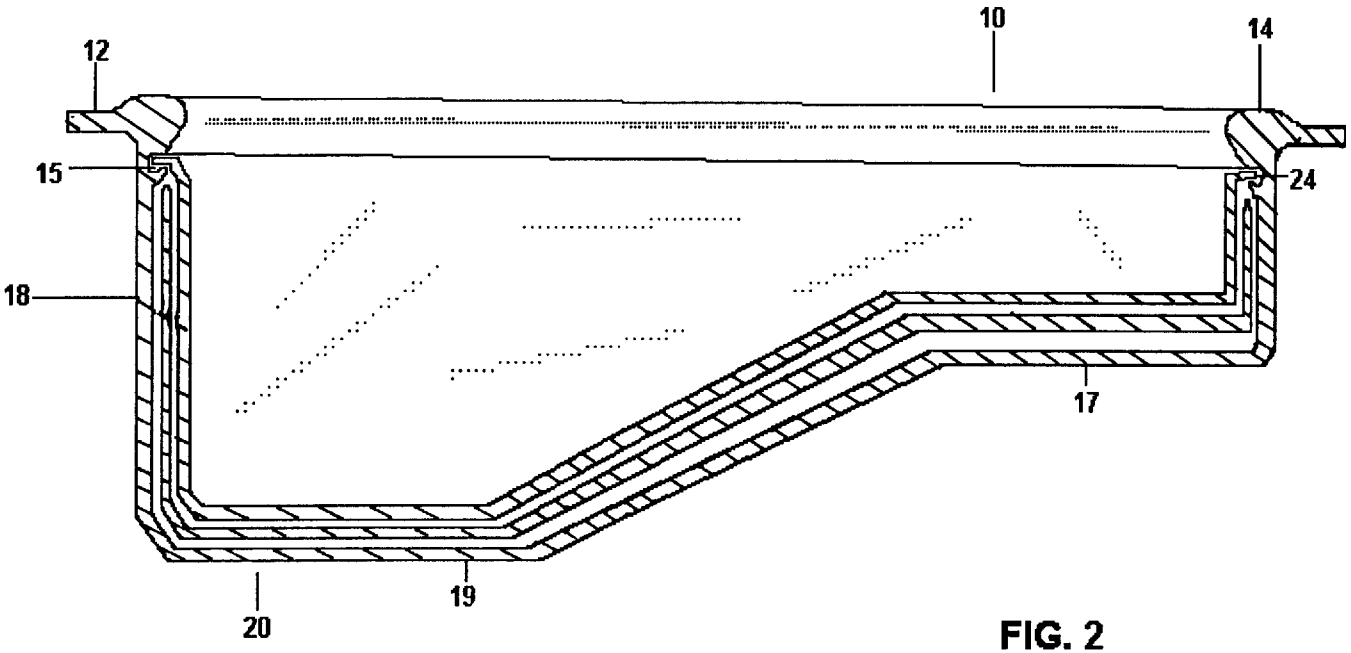
FIG. 2 is a cross-section of an elevational view of a typical construction of a vinyl-lined in-ground swimming pool with a liner installed.

Referring to FIGS. 1–3 and 11, it may be seen that a typical known in-ground pool 10 includes a deck 12, either of concrete, brick or wood. In a pool designed to accept a vinyl liner the deck 12 is edged by a continuous coping 14 which extends around the entire perimeter of pool 10 and has provided therein at least one continuous groove 15 direct ed inwardly and downwardly. The deck 12 and coping 14 surround an excavation which is defined by at least one continuous wall 18 having a height of about 42" inches and often having a rectangular or oval shape, and meeting a floor 20 which often has a planar shallow portion 17 which runs down into a deeper hopper portion 19 shaped like a hopper or well of varying depth. The wall 18 and floor 20 are lined by a semiflexible liner 22 usually made from polyvinyl chloride (PVC) with a gauge thickness of from 16 mm. to about 30 mm. and having a shape substantially conforming to the shape of excavation. FIG. 2 shows a pool 10 having a layer of polyethylene foam sheeting 21 between liner 22 and wall 18, although many pools were initially built without having this sheet layer. In many vinyl-lined pools 10, a liner 22 is attached to coping 14 by a bead 24 formed along a top edge of the liner 22. The bead 24 is inserted into groove 15 provided in the coping 14. The liner 22 is then substantially filled up to just a few inches below the coping 14 with water from a household tap and which is then chemically treated.

Above-ground pools (not shown), which are often surrounded by a wood or aluminum deck, similarly have walls which are substantially above the ground surface and supported by an external frame. However, in place of a coping, these often have a rim cap from two to six inches in width which sits on top of the upper edge of the pool walls. An above-ground pool liner is attached usually by one of two methods: [1] by draping the top of the liner over the edge of the wall and then placing the rim cap over and down onto the wall edge and liner; or [2] by providing a rim cap having a groove similar to that of in-ground pool coping 14, and, using a liner with an edge bead, inserting the edge bead into the groove of the rim cap.

The invention comprises a method whereby a new liner is installed directly over the pool's original surface, whether that original surface is a vinyl liner or concrete. The method further permits conserving preferably from 75%–98% of the pool water by scooping at least 50% of the water into the new liner, leaving 48% or less of the water to be transferred by pump into the new liner from between the old and new liners. The method requires that one edge of the new liner is weighted down so that it sinks to the bottom of the still-filled pool, using a weighted pulling means described hereinbelow. The new liner is then pulled across the bottom of the water-filled pool and pulled up the opposite side of the pool, effectively scooping up into the interior of the new liner most of the water which was in the pool. Most of the liner bead of the new liner is then installed into the pool's upper edge, usually into coping either pre-existing, newly installed or with adaptive means which form a part of the invention disclosed herein.

Figure 4:
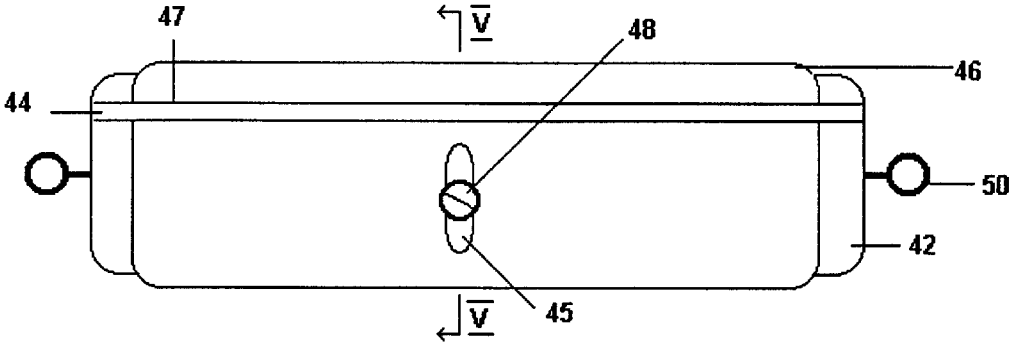
FIG. 4 is an elevational view of the weighted apparatus for attachment to the bead edge of a vinyl pool liner for pulling the liner across the bottom of a fluid-filled pool in accordance with the method of the invention.

With reference to FIGS. 4–9, the weighted pulling means 40 comprises a weighted cylindrical core 42 which has a longitudinally disposed slot 44 provided in the surface thereof. An outer sleeve 46 is sized to freely rotate around core 42 and has a slot 47 therethrough. Set screw 48 is provided extending through the wall of outer sleeve 46 via elongated hole 45 in outer sleeve 46 and may be used for fixing the relative positions of core 42 and sleeve 46 when a liner bead 24 is inserted therein as shown in FIG. 4. To secure liner 22 therein, sleeve 46 is positioned around core 42 such that core slot 44 and sleeve slot 47 are aligned, one directly above the other. Bead 24 of liner 22 is inserted through sleeve slot 47, into core slot 44 and sleeve 46 is rotated slightly, moving slots 44 and 47 slightly out of alignment. The misalignment should result in a clamping of the liner 22 between the edges of slots 44 and 47 sufficient to maintain bead 24 in pulling means 40 when subjected to the force normally exerted when pulling a liner underwater. Set screw 48 is then tightened to maintain the relative positions of core 42 and sleeve 46.

At either end of core 42 there is attached, installed or formed some linking means for attaching or linking the core 42 of one weighted pulling means 40 to another adjacent weighted pulling means 40, permitting daisy-chaining a series of weighted pulling means along an edge of a liner 22 to be installed. Linking means in the exemplary embodiment is a ring 50, attached at each end of core 42, although linking means could include clips, embedded rope loops and the like. Rope, chains or any equivalent flexible, semirigid or rigid structures may be used to link rings 50 of one pulling means 40 to those of the adjacent pulling means 40.

Preferably, core 42 and sleeve 46 of each weighted pulling means 40 are of approximately the same length, each having a length of from one-half inch to as much as four feet, with a length in the range of from four inches to one foot being preferable. Additionally, in this embodiment, it is preferable that the outer diameter of core 42 be only slightly less than the inner diameter of sleeve 46. The relative diameters should preferably be such that core 42 slides relatively easily within sleeve 46 by applying manual force.

Figure 7:
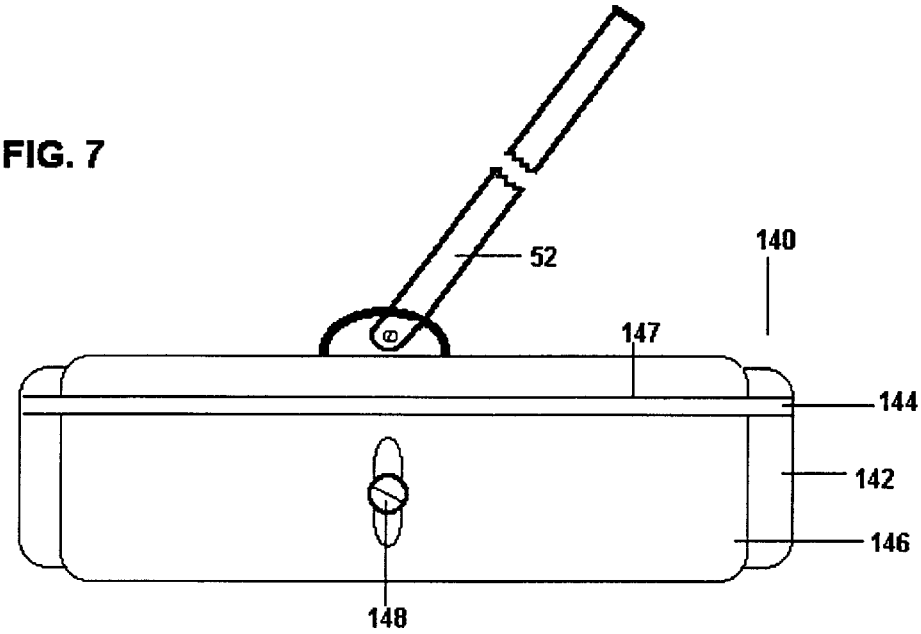
FIG. 7 is a detailed perspective view of a portion of an exemplary embodiment of pulling means used for practicing the inventive method.

Alternatively, as shown in FIG. 7, weighted pulling means 140 may be attached to a guide pole 52 having a length of at least four feet. A pulling means attached to a guidepole 52 permits a user to ensure that liner 22 is actually being held against the bottom of the pool as liner 22 is dragged from one end to the opposite end, not relying solely on the weight of pulling means 140.

Figure 8:
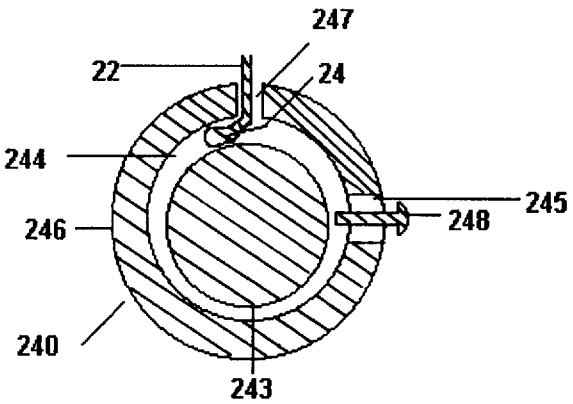
FIG. 8. is a cross-sectional view of another exemplary embodiment of a weighted pulling means which may be used to practice the invention.
Figure 9:
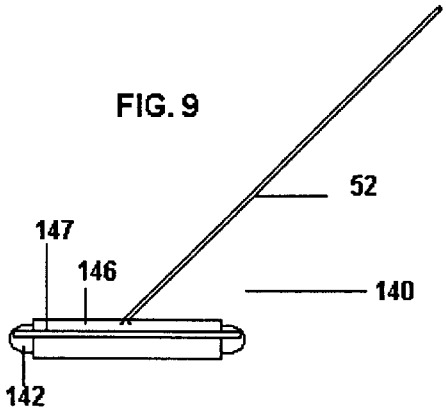
FIG. 9 is an elevational view of the exemplary embodiment shown in detail in FIG. 7.
Figure 11:
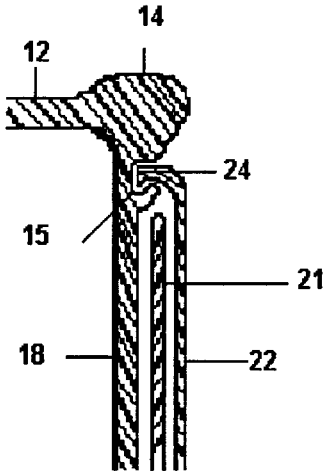
FIG. 11 is a cross-sectional view, in detail, of a portion of a vinyl-lined in-ground pool.

An alternative construction shown in FIG. 8 for weighted pulling means 240 comprises providing core 242 having an uninterrupted cylindrical surface, i.e. no slot. Sleeve 246 has an inner diameter sufficiently larger than the outer diameter of core 242 such t hat bead 24 can be inserted in between the opposing surfaces of core 242 and sleeve 246. When sleeve 246 is rotated around core 242, bead 24 is drawn in and sandwiched between the opposing surfaces 243 and 245. Set screw 48 is then tightened to maintain bead 24 in place while pulling means 240 is pulled across the pool bottom. This alternative construction may be adapted for use with ropes, chains, cables and the like as with pulling means 40 (FIG. 4) or for use with a guide pole 52 as with pulling means 140 (FIGS. 7 and 9). In the embodiment using guide pole 52, it is less necessary to provide pulling means 140 with substantial negative buoyancy, since the installer can apply manual force via pole 52 to keep the liner 22 submerged while being pulled across pool bottom 20.

As mentioned hereinabove, weighted pulling means 40, 140 or 240 should have an overall length in the clamping surfaces of at least one half inch, or that minimum length which will ensure that the vinyl liner is not damaged or unduly stretched in the clamped region. Core 42, 142 and 242 should have a length at least as great as sleeve 46, 146 or 246. The overall buoyancy of pulling means 40 and 240 should be negative, which could be achieved by selecting a core 42 or 242 made from negatively buoyant materials including brass, lead, concrete-or sand-filled PVC tubing, and the like.

One exemplary method for installing a new liner 23 over the existing liner 22 of an in-ground swimming pool 10 similar to that shown in FIG. 2, in accordance with the present invention, substantially comprises the steps of:

[a] using a suitable sharp edged instrument, slicing away a strip of about the uppermost one to four inches of the old liner 22;

[b] removing the upper portion of liner 22 from groove 15 in coping 14, by removing bead 24 from groove 15;

[c] inserting a portion of the bead 24 of new liner 23 into groove 15 of coping 14 at a first end 25 of pool 10;

[d] attaching pulling means 40, 140 or 240 for pulling new liner 23 along bottom 20 of pool 10 to the second end 27 of pool 10 and up wall 18 opposite the first end 25, capturing at least 50%, and preferably at least 80%, of the water in the pool;

[e] removing pulling means 40, 140 or 240 from the new liner 23 and attaching new liner 23 by inserting bead 24 into groove 15;

[f] transferring residual water from between old liner 22 and new liner 23 and depositing the new water into the new liner 23 using a pump or using the pool's own filtering system; and

[g] reinstalling fittings and main drain covers as necessary, removing pump lines from between liners 22 and 23 and perforating or slicing the old liner in the corners to permit drainage of any water remnant and finishing insertion of bead 23 into groove 15.

The pool which is the result of the above-described method is shown in FIG. 10. By following the above-enumerated steps, along with certain very minor preparatory steps and minor touches, using the apparatus described further hereinbelow a new pool liner can be completely installed over the old pool liner in as little as two hours, rather than two days required by dry relining methods. Additionally, the method requires no loss of water or pool chemicals. Little or no water transfer into or out of the pool occurs. Because the bottom and sides of the pool are at all times subject to the outward and downward forces of the water pressure, there is practically no risk of wall cave-in or bottom heaving. Moreover weather is no longer a major factor in determining when to install since higher than normal water tables are not a factor if the pool is never empty. Additionally, even during rainy seasons, it is not difficult to find two hours of light or no rain in which to work. The dramatically reduced time to install results in huge economies to the consumer and installer.

Additionally, because a film of water is present between old liner 22 and new liner 23 until the very end of the process, the liners can slide past one another easily thereby facilitating the self-adjustment of new liner 23 into the corners on old liner 22. Because of the water film, any liner stretching which may occur, if any, is nearly, if not completely, uniformly spread over the entire expanse of liner 23, thereby minimalizing any thinning of specific regions of new liner 23. This results in significantly reduced risk of leaks forming in thinned corner regions or of tears developing near the bead 24.

The exemplary methods require that the following preparatory steps be taken:

[1] Fittings and hardware installed on top of the old liner must be removed. The skimmer plate is a plate which seals the edges of the liner around the hole cut therein where water is taken from the surface of the pool into the filtration system. The plate prevents passage of water between the liner and the wall behind it. Many pools have plastic integrally-molded stairs installed in the shallow end of the pool to allow walk-in entry to the pool. A main floor drain for taking water from the pool bottom into the filtration system is covered by a strainer-style plate, similar in function to the skimmer plate, for maintaining a seal at the location in the liner of the main drain hole. All of these fittings should preferably be removed and retained for future reinstallation if desired. One may remove wrinkles in the old liner or fill in depressions in old liner using padding applied with adhesive formulated for underwater application. Especially with respect to the first exemplary method described above, it may be desirable to stabilize the position of the old liner to prevent shifting due to water travel after the plates and stairs have been removed. This can also be accomplished using using water-proof pressure sensitive adhesive tape.

[2] A structure must be provided around the top edge of the pool into which the bead of the new liner will be received. The first exemplary embodiment of the method accomplished this by slicing off an upper strip of the old liner 22, removing the strip and optionally, applying adhesive to the back side of the top edge of the thusly trimmed old liner, pressing that against the side of the pool to prevent its falling down during the installation process. These steps make groove 15 available as the new liner retaining means. In the exemplary embodiments shown in FIGS. 6, 12 and 13, a means for retaining bead 24 is provided.

Figure 12:
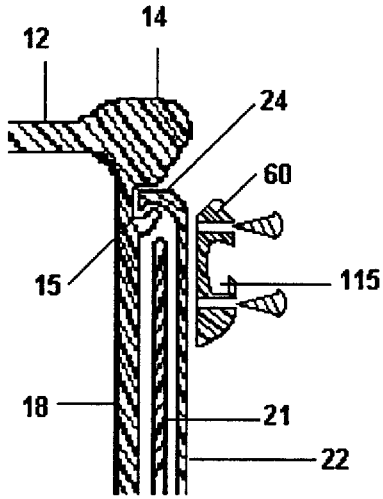
FIG. 12 is a cross-sectional view, in detail, of a portion of a vinyl-lined in-ground pool being fitted with liner retaining means comprising a liner-bead receiving track, shown exploded, in accordance with an exemplary embodiment of the present invention.

With reference to FIG. 12, a continuous track 60 having a groove 115 is screwed into the pool's wall directly over the old liner 22, just below the bead 24 thereof. This second exemplary embodiment is also very well adapted for installing a new vinyl liner into a cement pool or liquid storage tank which has an irreparable leak. Once track 60 is installed, the new liner is installed as described hereinabove with respect to steps [c]–[g] of the first exemplary embodiment, as follows:

[a] inserting a portion of the bead 24 of new liner 23 into groove 115 of track 60 at a first end 25 of pool 10;

[b] attaching pulling means 40, 140 or 240 for pulling new liner 23 along bottom 20 of pool 10 to the second end 27 of pool 10 and up wall 18 opposite the first end 25;

[c] removing pulling means 40, 140 or 240 from the new liner 23 and attaching new liner 23 by inserting bead 24 into groove 115 of track 60 nearly all the way around pool 10;

[d] transferring residual water from between old liner 22 and new liner 23 and depositing the water into the new liner 23 using a pump or using the pool's own filtering system; and

[e] reinstalling fittings and main drain covers as necessary, removing pump lines from between liners 22 and 23 and perforating or slicing the old liner in the corners to permit drainage of any water remnant and finishing insertion of bead 23 into groove 115.

Figure 6:
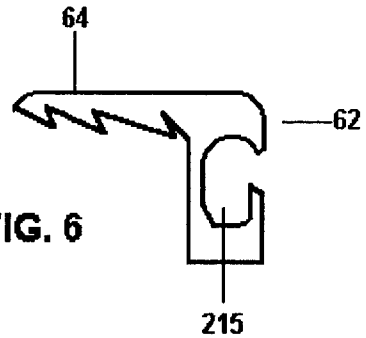
FIG. 6 is a cross-sectional view of an exemplary embodiment of a coping adapter which may be used for practising an alternative embodiment of the inventive method.
Figure 3:
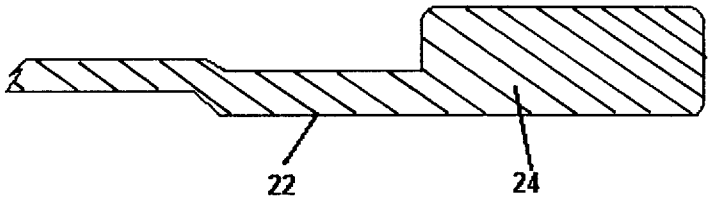
FIG. 3 is a cross-section of a detail view of the bead portion at the edge of a typical vinyl pool liner.
Figure 5:
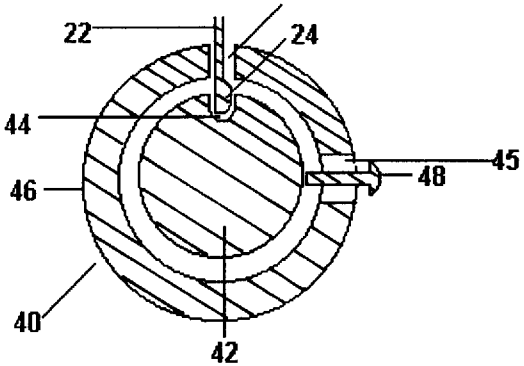
FIG. 5 is a cross-section of an apparatus for attachment to the bead edge of a vinyl pool liner for pulling the liner across the bottom of a fluid-filled pool in accordance with the method of the invention, taken along line V—V of FIG. 4, and having liner bead inserted therein.
Figure 13:
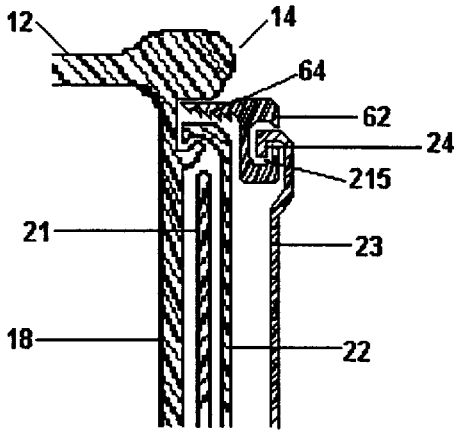
FIG. 13 is a cross-sectional view, in detail, of a portion of a vinyl-lined in-ground pool fitted with a new liner inserted into liner retaining means comprising the coping adapter shown in FIG. 6 hereinabove, in accordance with another exemplary embodiment of the present invention.

A third exemplary embodiment, with reference to FIGS. 6 and 13, requires installation of liner retaining means comprising a coping adapter 62 having a serrated blade 64 which can be inserted by force into exisiting groove 15 directly over old bead 23 of old liner 22. Once coping adapter 62 is installed, the new liner 24 is installed as follows:

[a] inserting a portion of the bead 24 of new liner 23 into groove 215 of coping adapter 62 at a first end 25 of pool 10;

[b] attaching pulling means 40, 140 or 240 for pulling new liner 23 along bottom 20 of pool 10 to the second end 27 of pool 10 and up wall 18 opposite the first end 25;

[c] removing pulling means 40, 140 or 240 from the new liner 23 and attaching new liner 23 by inserting bead 24 into groove 215 of coping adapter 62 nearly all the way around pool 10;

[d] transferring residual water from between old liner 22 and new liner 23 and depositing the water into the new liner 23 using a pump or using the pool's own filtering system; and

[e] reinstalling fittings and main drain covers as necessary, removing pump lines from between liners 22 and 23 and perforating or slicing the old liner in the corners to permit drainage of any water remnant and finishing insertion of bead 23 into groove 215.

These last two embodiments permit installation of the new liner 24 directly over the old liner 22 without having to slice or stabilize the top of the old liner. Only areas where fittings have been temporarily removed may need stabilization using adhesive, for example, where molded plastic stairs are installed with the liner running between a sealing trim plate and the stairs underneath.

To elaborate on the methods as described hereinabove, once provision has been made for receiving the bead of the new liner, at least one weighted liner dragging means for pulling the liner along the bottom of a water-filled pool is attached to one end of the new liner and the liner is pulled across the pool and the bead is inserted substantially all the way around the pool, except for the places where pump hoses are run down between the old and new liners.

Water remaining between the old and new liners is pumped into the new liner. The film of water which is finally left between the old and new liners permits the new liner to slide over the old liner and easily settle, practically without guidance into place in the corners. Any stretching and thinning of the new liner due to undersizing is spread uniformly or nearly so throughout the expanse of the new liner, thereby minimizing the risks of weakening localized areas and seriously shortening the liner's life.

With reference now to FIGS. 14–16, another application of the method is to install a specialized liner 70 which may be manufactured from PVC or any other similar material which is flexible enough to mold to the shape of the pool and chemically stable enough to withstand the corrosive effects of the cleaning solutions employed for removing pool stains. The liner 70 is constructed to so that it merely approximates the shape of a pool's wall 18 and floor 20 and extend up above water level or higher at its upper edges 76. Liner 70 is provided with a bubbled outer surface 72 as in FIG. 15, a vertically ridged outer surface 74 as in FIG. 16, or some other uneven outer surface, whereby the contact between the surfaces of liner 70 and the wall 18 and floor 20 surfaces are interrupted. The interruption of contacting surface areas permits fluid to travel between the contacting surfaces of liner 70 and wall 18 and floor 20. The liner 70 is installed as follows:

[a] attaching pulling means 40, 140 or 240 for pulling liner 70 along bottom 20 of pool 10 to the second end 27 of pool 10 and up wall 18 opposite the first end 25, with the outer surface 72 or 76 of liner 70 facing outward to contact pool floor 20 and walls 18;

[b] pulling the edges 76 of liner 70 up and out of the water and onto deck 12 or coping 14, temporarily immobilizing liner 70, and removing pulling means 40, 140 or 240 from liner 70;

[c] transferring residual water from between wall 18, floor 20 and liner 70 and depositing the water into liner 70 using a pump;

[d] pumping bleaching solution, cleaning solution, muriatic acid or other like cleaning solutions into the spaces between liner 70 and wall 18 and floor 20 for a desired time; and

[e] removing and recapturing the cleaning solution using the pump, removing pump lines from between liner 70 and wall 18 and removing liner 70 by simply sliding it back out of pool 10.

By using the disclosed cleaning method, worker and environmental exposure to the chemicals and fumes are practically eliminated. The cleaning solutions are nearly completely recaptured for recycling or appropriate treatment or disposal. The entire operation is accomplished in a matter of hours rather than days. All the benefits and advantages attributed to the new liner installation methods described hereinabove are equally applicable to the cleaning method disclosed, including reduced risk to the installer, speed of completion of work, reduced risk of further damage to fragile pools, etc.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

I claim:

1. A method for installing a liner into a swimming pool having at least one wall, a bottom, an upper periphery and containing a fluid, said liner comprising a sheet of flexible plastic material having an outer edge and a shape roughly conforming to said swimming pool said swimming pool including retaining means for receiving and maintaining said outer edge of said liner adjacent said upper periphery, said method substantially comprising the steps of:

[a] securing a portion of said outer edge at a first position of said liner retaining means at a first wall position on said wall;

[b] attaching pulling means for pulling said liner to said outer edge at a second position of said liner substantially opposite said first position of said liner;

[c] pulling said pulling means along the bottom of said A swimming pool to a second wall position opposite said first wall position and securing said outer edge into said liner retaining means, whereby at least 50% of said fluid is scooped up into said liner; and

[d] pumping fluid directly into said liner from between the wall and floor and said liner;

whereby at least 75% of said fluid is conserved by said method.

2. The method for installing a liner into a swimming pool in accordance with claim 1, wherein said liner retaining means comprises a continuous liner-edge retaining track attached to said wall of said pool at a position adjacent to and completely around said upper periphery of said pool.

3. The method for installing a liner into a swimming pool in accordance with claim 2, wherein said pulling means is attached to said outer edge by evenly clamping a length of at least one-half inch of said outer edge.

4. The method for installing a liner into a swimming pool in accordance with claim 2, wherein said pulling means has negative buoyancy such that said liner sinks to said bottom of said fluid and having at least one elongated pulling member extending therefrom for pulling said pulling means and said liner from a distance, said elongated member having a length of at least four feet.

5. The method for installing a liner into a swimming pool in accordance with claim 1, wherein said pulling means is attached to said outer edge by evenly clamping a length of at least one-half inch of said outer edge.

6. The method for installing a liner into a swimming pool in accordance with claim 5, wherein said pulling means has negative buoyancy such that said liner sinks to said bottom of said fluid and having at least one elongated pulling member extending therefrom for pulling said pulling means and said liner from a distance, said elongated member having a length of at least four feet.

7. The method for installing a liner into a swimming pool in accordance with claim 1, wherein said pulling means has negative buoyancy such that said liner sinks to said bottom of said fluid and having at least one elongated pulling member extending therefrom for pulling said pulling means and said liner from a distance, said elongated member having a length of at least four feet.

8. The method for installing a liner into a swimming pool in accordance with claim 1, wherein said pulling means has at least one rigid and elongated pulling member extending therefrom for pulling said pulling means and said liner from a distance, said elongated member having a length of at least four feet.

9. A swimming pool having a first installed liner, said swimming pool and first liner containing a fluid, said swimming pool having at least one wall, a bottom, and an upper periphery having liner retaining means provided therein, the second liner being installed directly over said first liner, said first liner and said second liner each comprising a sheet of flexible plastic material having an outer edge and a shape substantially conforming to the swimming pool, said liner retaining means including a groove for receiving said liner outer edge, said first liner outer edge being installed in said groove, said method substantially comprising the steps of:

making said liner retaining means available for receiving and maintaining in place said outer edge of said second liner, said liner retaining means being made available by separating from the rest of said first liner an upper portion including said outer edge of said first liner, and removing said upper portion and said outer edge of said first liner from said liner retaining means;

securing a portion of said outer edge of said second liner at a first position of said liner retaining means at a first wall position on said wall;

attacking said outer edge of said second liner to pulling means for pulling said second liner, said pulling means being attached at a second position of said second liner substantially opposite said first position of said second liner;

pulling said pulling means along the bottom of said swimming pool to a second wall position opposite said first wall position and securing said outer edge of said second liner into said liner retaining means, whereby at least 50% of said fluid is scooped up into said second liner; and pumping fluid directly into said second liner from between said first liner and said second liner;

whereby at least 75% of said fluid is conserved by said method.

10. The method for installing a liner into a swimming pool in accordance with claim 9, wherein said pulling means is attached to said outer edge by evenly clamping a length of at least one-half inch of said outer edge.

11. The method for installing a liner into a swimming pool in accordance with claim 10, wherein said pulling means has negative buoyancy such that said liner sinks to said bottom of said fluid and having at least one elongated pulling member extending therefrom for pulling said pulling means and said liner from a distance, said elongated member having a length of at least four feet.

12. The method for installing a liner into a swimming pool in accordance with claim 10, wherein said pulling means has at least one rigid and elongated pulling member extending therefrom for pulling said pulling means and said liner from a distance, said elongated member having a length of at least four feet.

13. The method for installing a liner into a swimming pool in accordance with claim 9, wherein said pulling means has negative buoyancy such that said liner sinks to said bottom of said fluid and having at least one elongated pulling member extending therefrom for pulling said pulling means and said liner from a distance, said elongated member having a length of at least four feet.

14. The method for installing a liner into a swimming pool in accordance with claim 9, wherein said pulling means has at least one rigid and elongated pulling member extending therefrom for pulling said pulling means and said liner from a distance, said elongated member having a length of at least four feet.

15. A method for installing a second liner into a swimming pool having a first installed liner, said swimming pool and first liner containing a fluid, said swimming pool having at least one wall, a bottom and an upper periphery having liner retaining means provided therein, the second liner being installed directly over said first liner, said first liner and said second liner each comprising a sheet of flexible plastic material having an outer edge and a shape substantially conforming to the swimming pool, said liner retaining means including a groove for receiving said liner outer edge said first liner being installed with said outer edge installed in said groove, said method substantially comprising the steps of:

installing second liner retaining means for receiving and maintaining in place said outer edge of said second liner, said second retaining means comprising a continuous liner-edge retaining track, and said installation comprising attaching said continuous liner-edge retaining track to said wall of said pool at a position adjacent to and completely around said upper periphery of said pool and directly on top of said first liner;

securing a portion of said outer edge of said second liner at a first position of said second liner retaining means at a first wall position on said wall;

attaching said outer edge of said second liner to pulling means for pulling said second liner, said pulling means being attached at a second position of said second liner substantially opposite said first position of said second liner;

pulling said pulling means along the bottom of said swimming pool to a second wall position opposite said first wall position and securing said outer edge of said second liner into said second liner retaining means, such that at least 50% of said fluid is scooped up into said second liner; and pumping fluid directly into said second liner from between said first liner and said second liner;

whereby at least 75% of said fluid is conserved by said method.

16. The method for installing a liner into a swimming pool in accordance with claim 15, wherein said pulling means is attached to said outer edge by evenly clamping a length of at least one-half inch of said outer edge.

17. The method for installing a liner into a swimming pool in accordance with claims 16, wherein said pulling means has at least one rigid and elongated pulling member extending therefrom for pulling said pulling means and said liner from a distance, said elongated member having a length of at least four feet.

18. The method for installing a liner into a swimming pool in accordance with claim 16, wherein said pulling means has negative buoyancy such that said liner sinks to said bottom of said fluid and having at least one elongated pulling member extending therefrom for pulling said pulling means and said liner from a distance, said elongated member having a length of at least four feet.

19. The method for installing a liner into a swimming pool in accordance with claims 15, wherein said pulling means has negative buoyancy such that said liner sinks to said bottom of said fluid and having at least one elongated pulling member extending therefrom for pulling said pulling means and said liner from a distance, said elongated member having a length of at least four feet.

* * * * *